United States Patent [19]

Farrell et al.

[11] 4,139,746

[45] Feb. 13, 1979

[54] SLIDE SWITCH CONSTRUCTIONS

[75] Inventors: Guy M. Farrell, Elmhurst; Martin Gaber, Wilmette; Joseph J. Spedale, Chicago, all of Ill.

[73] Assignee: Chicago Switch, Inc., Chicago, Ill.

[21] Appl. No.: 839,442

[22] Filed: Oct. 5, 1977

[51] Int. Cl.[2] ..... H01H 15/06

[52] U.S. Cl. ..... 200/16 D

[58] Field of Search ..... 200/16 C, 16 D

[56] References Cited

U.S. PATENT DOCUMENTS

| | | | |
|---|---|---|---|
| 1,815,577 | 7/1931 | Nenzel | 200/16 D |
| 2,691,702 | 10/1954 | Allison | 200/16 D |
| 3,399,282 | 8/1968 | Nagashima et al. | 200/16 D X |
| 3,501,599 | 3/1970 | Horecky | 200/16 D |
| 3,592,982 | 7/1971 | Deltoer | 200/16 D |
| 3,632,909 | 1/1972 | Rowley | 200/16 D |
| 4,013,855 | 3/1977 | Reicher et al. | 200/16 D X |
| 4,072,839 | 2/1978 | Spedale | 200/16 R X |

FOREIGN PATENT DOCUMENTS

| | | | |
|---|---|---|---|
| 1205925 | 9/1970 | United Kingdom | 200/16 D |

*Primary Examiner*—James R. Scott

*Attorney, Agent, or Firm*—McDougall, Hersh & Scott

[57] ABSTRACT

A slide switch construction including at least two spaced apart contacts positioned on a base with a slider and bridging contactor assembly attached to the base in a manner such that the assembly is movable over the base for changing switch positions. The bridging contactor comprises a strip of resilient material defining an elongated bridging portion with at least one spring arm extending outwardly from the bridging portion. An engaging surface is defined by the slider for engagement with the spring arm to bend the spring arm relative to the bridging portion when the assembly is attached to the base thereby achieving pressing of the bridging portion against the contacts. Hanger means are defined by the contactor and by the slider to serve as means for holding the slider and contactor together when the assembly is separated from the base.

4 Claims, 11 Drawing Figures

SLIDE SWITCH CONSTRUCTIONS

BACKGROUND OF THE INVENTION

This invention relates to a slide switch construction, for example switches of a so-called double pole-double throw construction. The slide switch is characterized by a base defining at least two contacts and an assembly including a slider and a bridging contactor. When the assembly is attached to the base, the slider provides for sliding movement of the bridging contactor relevant to the spaced apart contacts for changing switch positions.

Spedale application Ser. No. 695,936, filed June 14, 1976, now U.S. Pat. No. 4,072,839 describes a slide switch construction which particularly includes means for holding a slider and bridging contactor in the assembled relationship when the assembly is separated from the base. This arrangement facilitates shipping of the base and of the assembly as separate items whereby the user can attach the base to a PC board or the like. This attaching operation and other operations involved in the construction of the PC board usually involves soldering whereby contaminants are likely to collect on contact surfaces. The Spedale construction permits the undertaking of the assembly operations with the slider assembly being kept away from the contaminating atmosphere. After completion of the assembly operations, particularly the soldering, the contacts on the base can be readily cleaned. Thereafter, the slider assembly is snapped into place with the respective contact surfaces being free of contamination occasioned by the assembly operation.

SUMMARY OF THE INVENTION

This invention comprises a slide switch construction which includes unique means for holding sliders and bridging contactors in assembly when separated from the base to be employed in association with the assembly. The invention is particularly concerned with simplified designs for the slider and bridging contactors whereby these elements can be produced and assembled in a highly efficient manner. The slide switch particularly includes a bridging contactor in assembly with a slider with the contactor including an elongated bridging portion and at least one spring arm extending outwardly from the bridging portion. An engaging surface is defined by the slider for engagement with the spring arm when the assembly is attached to the base. This engagement provides for the pressing of the bridging portion against the contacts on the base whereby the bridging portion is resiliently urged against the contacts during switch operation.

Hanger means are also defined by the bridging contactor and by the slider. These hanger means serve as means for holding the slider and contactor in the assembled relationship when this assembly is separated from the base. Thus, the bridging contactor and slider can be handled separately from the base without disturbing the assembled relationship.

DESCRIPTION OF THE PREFERRED EMBODIMENTS

Figure 1:
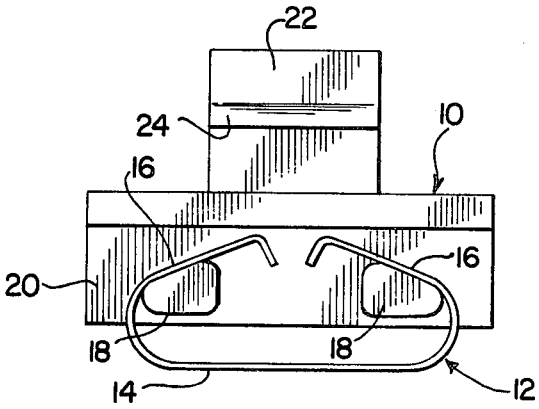
FIG. 1 is a side elevation of a bridging contactor and slider assembly.
Figure 2:
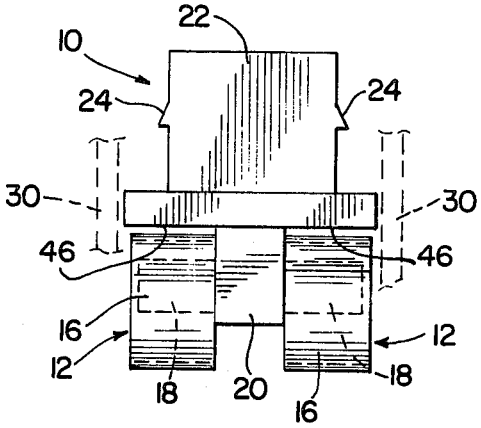
FIG. 2 is an end view of the assembly of FIG. 1.

FIGS. 1 and 2 illustrate a form of the invention including a slider 10 and bridging contactors 12. The bridging contactors include an elongated bridging portion 14 and a pair of spring arms 16. These spring arms 16 are turned inwardly whereby they are adapted to hang on studs 18 which extend outwardly from the downwardly extending section 20 of the slider 10. The upper section 22 of the slider comprises an engaging button for manual operation of the switch. A pair of nibs 24 extend outwardly from opposite side walls of this button. It will be understood that in all instances, the sliding action could be achieved by some mechanical means.

Figure 3:
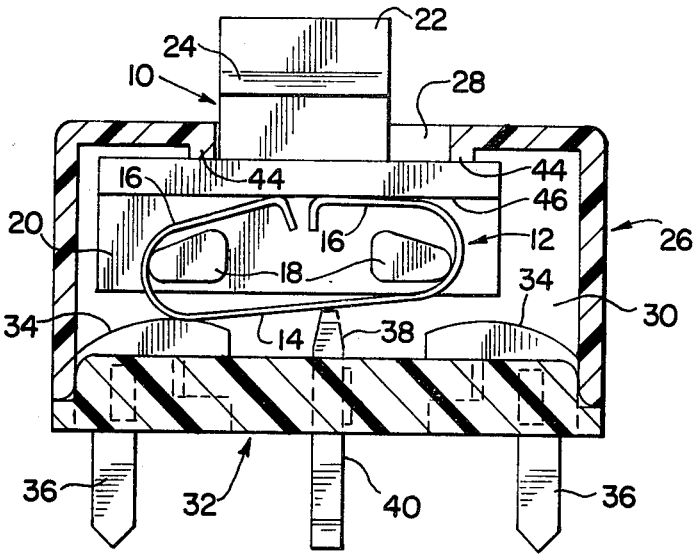
FIG. 3 is a vertical, sectional view of a switch construction including the assembly of FIG. 1.

FIG. 3 illustrates an enclosure 26 which serves as an upper housing for the switch construction. This enclosure defines a central opening 28 which is adapted to receive the button 22. The opening 28 has substantially the same dimensions as the distance between the button side walls carrying the nibs 24. The housing and button are formed of plastic with resilient characteristics whereby the nibs 24 are adapted to be forced beyond the opening 28 with the nibs then serving to hold the slider and housing together.

In the use of the construction of FIGS. 1 and 2, the contactors 12 are readily located in assembly with the slider 10 by simply hanging the contactors onto the studs 18. As illustrated in dotted lines in FIG. 2, the side walls 30 of the enclosure 26 will automatically hold the contactors 12 in place when the assembly of the slider 10 and contactors 12 is engaged with the enclosure. It will be appreciated that the enclosure will maintain the assembled relationship of the slider and contactors without difficulty so that the construction can be handled, shipped, etc., without any likelihood of the bridging contactors being displaced from association with the slider.

FIG. 3 also illustrates a switch base construction 32 of the type described in the aforementioned Spedale application. This base supports a pair of outer contacts 34 having terminals 36 for connection with leads such as conductive strips on a PC board. A central fulcrum contact 38 is provided with terminal 40.

As set forth in the aforementioned application, the base 32 is adapted to be assembled with the enclosure 26, for example by means of tabs carried by the base which are receivable within corresponding openings in the side walls of the enclosure. It will be appreciated that the base and enclosure designs are provided for purposes of illustration, and that various conventional arrangements could be utilized along with any suitable means of attachment.

As shown in FIG. 3, the bridging contactor 12 is held in engagement with the contacts 34 and 38 when the base and enclosure are attached. More specifically, the slider 10 is pressed against the flange area 44 defined by the upper wall of the enclosure for bearing contact therewith. The spring arms 16 are in turn pressed against the surfaces 46 defined by the slider with these arms being bent relative to the bridging portion 14. This results in pressing of the bridging portion against the stationary contacts.

As noted, the studs 18 serve as hangers for the bridging contactors when the assembly of the slider and contactors is separated from the base. In the position of FIG. 3, the studs 18 assume the function of drive members for the bridging contactor during switch operation. Specifically, these studs bear against the interior surfaces of the bridging contactor, and when the slider 10 is driven between the respective switch positions, the studs serve as the means for driving the bridging contactor along with the slider. This provides positive force application to the bridging contactor and insures smooth switch operation. Specifically, the utilization of the studs as drive members greatly minimizes arcing possibilities and other detrimental effects characteristic of erratic making and breaking of contacts.

As indicated, the structure of this invention is suitable for use in association with switches of the type described in the aforementioned Spedale patent. It will be specifically understood that the bridging contactors 12 may engage completely independent contacts or that connections may be made to achieve redundancy. The switch constructions are specifically suitable for connection whereby single pole-single throw, single pole-double throw, double pole-double throw and form "Z" slide action circuits can all be achieved.

The manner in which the construction can be used to insure uncontaminated contacts will also be apparent. Thus, the base 32 will be associated with a PC board or the like with the enclosure 26 carrying the slider and contactor assembly being at this time separated from the base. Soldering operations and cleaning of the switch contacts are then conducted. Thereafter, the enclosure is snapped into position so that all of the contact surfaces are free of contamination.

Figure 5:
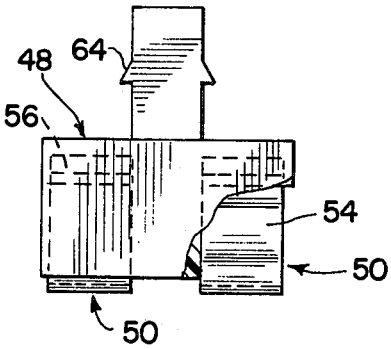
FIG. 5 is an end view of the assembly of FIG. 4.
Figure 4:
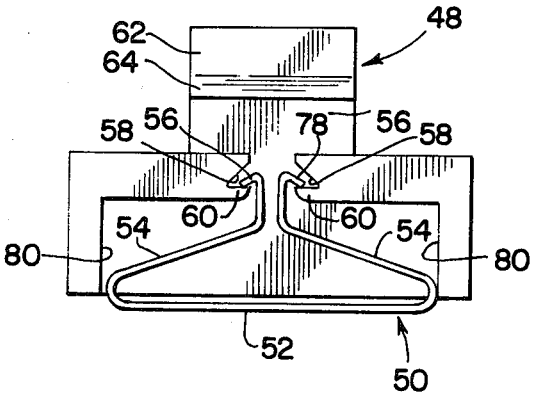
FIG. 4 is a side elevation of an assembly in accordance with a modified form of the invention.
Figure 6:
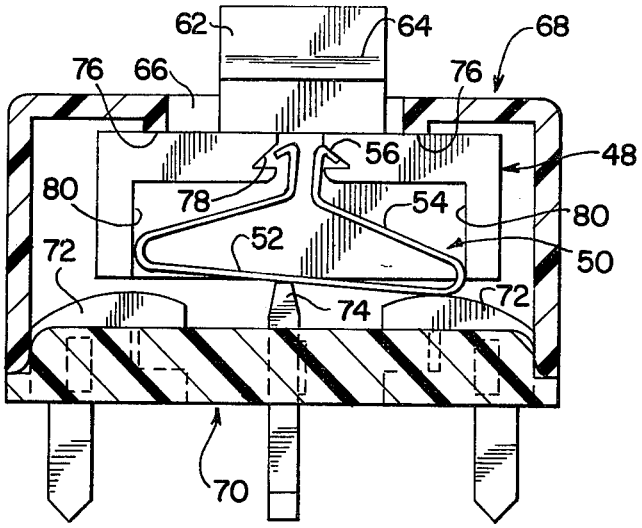
FIG. 6 is a vertical, sectional view of a switch construction including the assembly of FIG. 4.

FIGS. 4, 5 and 6 illustrate a modified version of the invention. In this instance, a slider 48 supports a pair of bridging contactors 50. These contactors include an elongated bridging portion 52 and spring arms 54. The arms each define fingers 56 which extend into pockets 58 defined by the slider. Shoulders 60 are provided at the bottom of the pockets, and as shown in FIG. 4, the fingers and shoulders comprise hanging means whereby the contactors 50 are adapted to be held in assembled relationship with the slider 48.

The slider 48 defines a button section 62 carrying nibs 64 whereby the slider is receivable within the opening 66 of enclosure 68. In the same fashion as described with reference to FIG. 3, the base 70 is adapted to be associated with the enclosure whereby the contactor 50 is brought into engagement with contacts 72 and 74 carried by the base. In this condition of the construction, the slider bears against the flange portion 76 of the enclosure, and a finger 56 of one spring arm 54 engages surface 78 of one pocket 58. The one spring arm 54 is, therefore, bent relative to bridging portion 52 to achieve pressure of the bridging portion against the contacts.

In the operation of the switch, the button 62 is utilized for driving the slider and the contactor 50 is simultaneously driven primarily due to engagement of an end wall 80 of the slider with the contactor. Thus, a positive driving action between the slider and contactor is achieved.

As in the case of the arrangement of FIGS. 1 through 3, the enclosure walls operate to hold the slider and contactors in assembly when this assembly is separated from the base. It will be apparent that the contactors are very easily moved into position relative to the slider and that the enclosure is very easily snapped into place relative to the slider. Accordingly, the advantages of the invention are achieved without the necessity for any complicated manufacturing or assembly operations.

Figure 7:
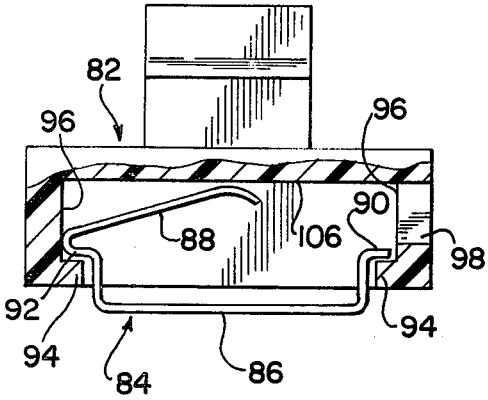
FIG. 7 is a side elevation, partly in section, of an assembly comprising an additional modified form of the invention.
Figure 8:
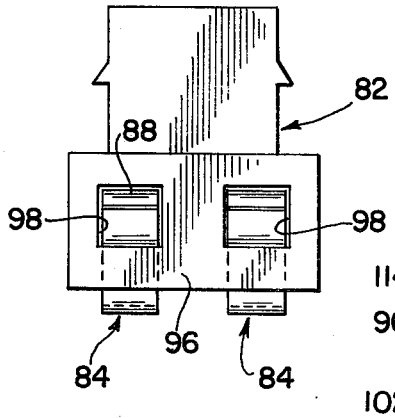
FIG. 8 is an end view of the assembly of FIG. 7.
Figure 9:
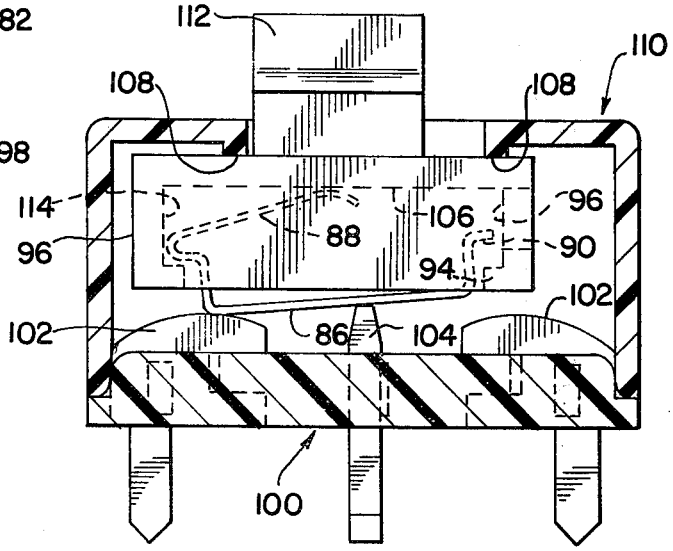
FIG. 9 is a vertical, sectional view of a switch construction including the assembly of FIG. 7.

FIGS. 7 through 9 illustrate a further modification of the invention. In this construction, slider 82 is associated with contactor 84. The contractor includes a bridging portion 86 and a single spring arm 88.

An outwardly extending finger 90 is formed at one end of the bridging contactor, and a shoulder 92 is formed at the other end adjacent the bend between the spring arm and the bridging portion. Oppositely disposed flanges 94 are defined by the interior end walls 96 of the slider whereby the contactor is adapted to hang in position after assembly of the slider and contactor.

The slider defines a pair of windows 98 in one end wall to be employed for assemblying the slider and contactor. Specifically, the assembly operation simply involves the forcing of each contactor through a window with the resilience of spring arm 88 readily permitting this. Once located within the slider, the contactor hangs in place. This arrangement differs from the foregoing embodiments in that the slider and contactor do not require the enclosure walls as a means for maintaining the assembled relationship. This arrangement thus provides flexibility in terms of the enclosure design. Furthermore, there is versatility relative to switch actuation since the actuating button or the like could extend from the side wall of the slider.

As shown in FIG. 9, the assembly of the slider 82 and contactor 84 is adapted for association with base 100 carrying contacts 102 and 104. When assembled with the base, the spring arm 88 is pressed against the surface 106 of the slider. This insures pressing of the bridging portion 88 of the contactor against the stationary contacts.

The slider bears against flange portions 108 of the enclosure 110 during movement of the slider by means of button 112. Positive driving action is achieved through engagement of the slider with the contactor. Specifically, the inner wall 114 engages the bend between the bridging and spring arm portions during movement in one direction, while wall 96 engages the driving or pushing movement in the opposite direction.

Figure 10:
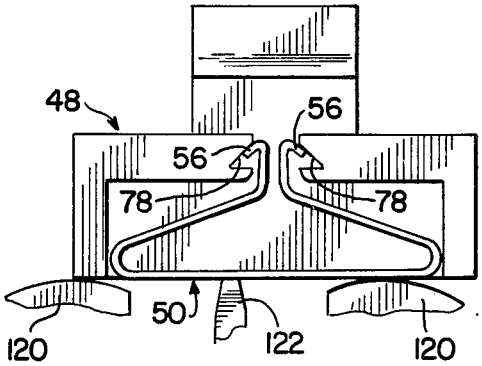
FIG. 10 is a fragmentary view illustrating an assembly of the type shown in FIG. 4 in association with different stationary contacts; and, FIG. 11 is a fragmentary view illustrating an assembly of the type shown in FIG. 1 in association with different stationary contacts.

In the embodiments described, the contactors pivot between switch positions due to the provision of a central stationary contact acting as a fulcrum. The concepts of this invention are also applicable to an arrangement such as shown in FIG. 10 wherein the contact surfaces of stationary contacts 120 and 122 are in substantially the same plane. In this illustration, contactor 50 is driven by slider 48 in an essentially parallel path with the fingers 56 both being engaged by the engaging surfaces 78 of the slider. This maintains the parallel relationship of the bridging contactor with the slider while also achieving the contact pressure.

Figure 11:
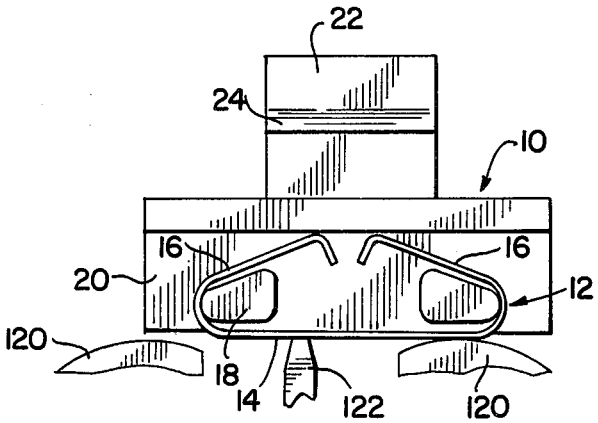

FIG. 11 illustrates a similar arrangement embodying contactors 12 and slider 10 of FIG. 1 in engagement with contacts 120 and 122. It will be particularly noted that the studs 18 conform closely with the bends of the contactors whereby switching action involves engagement of the respective studs in a manner such that the contactors are "pulled" by the studs. This close conformance, and the fact that the center lines of the contactor bends are substantially in line with the "nose" portions of the studs, also tends to further reduce the possibility of cocking movement of the contactor relative to the stationary contacts. A smooth switch operation is thereby achieved.

It will be understood that various changes and modifications may be made in the above described construction which provide the characteristics of this invention without departing from the spirit thereof particularly as defined in the following claims.

That which is claimed is:

1. In an assembled slide switch construction wherein at least two contacts are positioned on a base, a slider, and a bridging contactor in assembly with said slider, means for attaching the slider assembly to the base while permitting sliding movement of the slider assembly relative to the base whereby the contactor shifts between a first position completing a circuit between the contacts and a second position whereat the contactor is out of engagement with at least one contact, resilient means for pressing the contactor against the contacts on the base during switch operation, and including means for holding the slider and contactor together whereby the assembly thereof remains intact when separated from the base, the improvement wherein said contactor comprises a strip of resilient material, said strip defining an elongated bridging portion, spring arms formed at each end of the bridging portion, said arms comprising opposed return portions, said slide defining a central portion extending toward said base, laterally extending supporting stud means formed on said central portion of said slider, said return portions extending around said stud means, a separate engaging surface defined by said slider adjacent said central portion for engaging said spring arms, said stud means being positioned between said engaging surface and said base, said engaging surface pressing the spring arms whereby the spring arms bend relative to said bridging portion when the assembly is attached to the base to achieve pressing of said bridging portion against said contacts, said stud means serving as hanger means for holding said assembly intact when the assembly is separated from said base, and said stud means serving as drive means which are driven against said contactor during sliding movement of the slider assembly to achieve movement of said contactor relative to the base.

2. A construction in accordance with claim 1 wherein said slider is assembled with a pair of said contactors, said stud means extending on opposite sides of said central portion to support the separate contactors, and separate sets of contacts being positioned on said base for engagement by the respective contactors.

3. A construction in accordance with claim 2 including an enclosure for said assembly, said enclosure defining side walls positioned adjacent contactors hanging on the stud means, said side walls preventing dislodging of said contactor off of said stud means.

4. A construction in accordance with claim 2 wherein said stud means comprise a pair of spaced-apart studs, said spring arms defining inwardly facing bends, said studs being received within said bends when said contactor is assembled with said slider.

* * * * *